United States Patent [19]

Palmer

[11] 4,265,067

[45] May 5, 1981

[54] FOAMED PLASTIC CORE DOOR

[75] Inventor: Fred I. Palmer, St. Charles, Ill.

[73] Assignee: Masonite Corporation, Chicago, Ill.

[21] Appl. No.: 36,299

[22] Filed: May 7, 1979

[51] Int. Cl.[3] ..... E04C 2/20

[52] U.S. Cl. ..... 52/309.9; 52/407

[58] Field of Search ..... 52/309.9, 309.11, 404, 52/309.4, 407, 455, 456, 314, 809, 795; 428/158, 160, 167; 5/481

[56] References Cited

U.S. PATENT DOCUMENTS

| | | | |
|---|---|---|---|
| 3,000,144 | 9/1961 | Kitson | 52/309.11 |
| 3,339,325 | 9/1967 | Knapp | 52/309.4 |
| 3,364,639 | 1/1968 | Davenport | 52/407 |
| 3,412,513 | 11/1968 | Gosele | 52/809 |
| 3,462,897 | 8/1969 | Weinrott | 52/309.11 |
| 3,479,779 | 11/1969 | Ziegler | 52/309.11 |
| 3,546,841 | 12/1970 | Smith | 52/309.11 |
| 3,785,103 | 1/1974 | Turner | 52/309.11 |

FOREIGN PATENT DOCUMENTS

| | | | |
|---|---|---|---|
| 2729778 | 1/1978 | Fed. Rep. of Germany | 52/309.9 |

*Primary Examiner*—John E. Murtagh

*Attorney, Agent, or Firm*—Mason, Kolehmainen, Rathburn & Wyss

[57] ABSTRACT

A foamed plastic core door, structural panel or closure member comprises an inner core of light weight, cellular, foamed plastic material having opposite outwardly facing side surfaces, each formed with a base portion having a plurality of relatively small, integrally formed, outwardly projecting, compressible bosses arranged at spaced apart intervals thereon. At least one outer skin or decorative door face member is provided having an inside surface confronting said core surface in facing spaced apart relation with the base portion and in adhesive contact against the outer faces of a plurality of the projecting bosses, thus, providing a thin, dead air, insulating space between a major area portion of the side face of the core and the adjacent confronting inside surface of the outer skin.

18 Claims, 7 Drawing Figures

Fig. 4
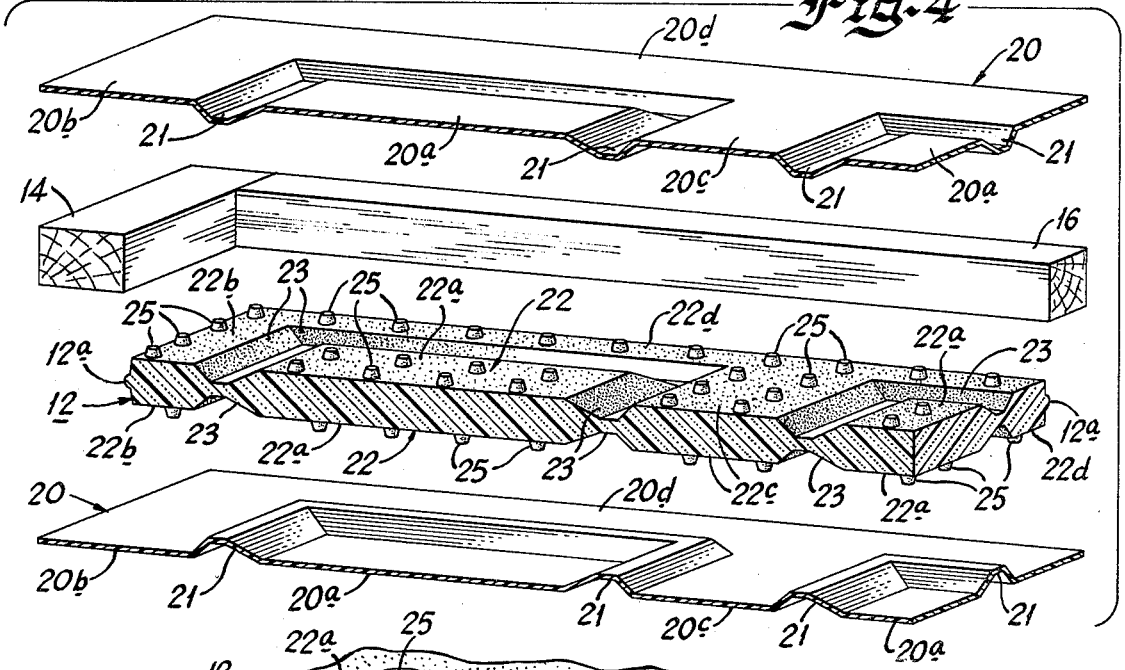
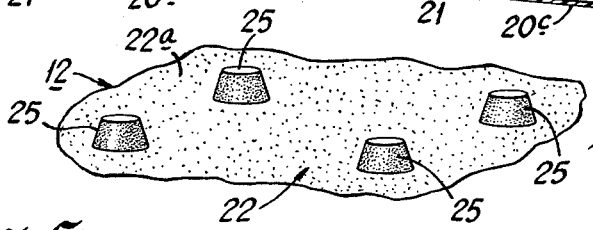
Fig. 5
Fig. 6
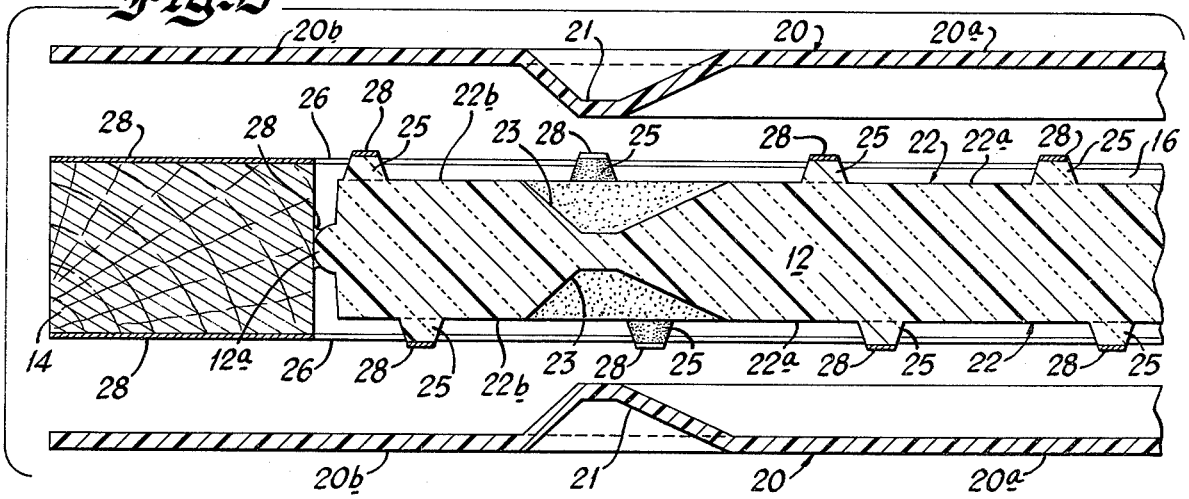
Fig. 7
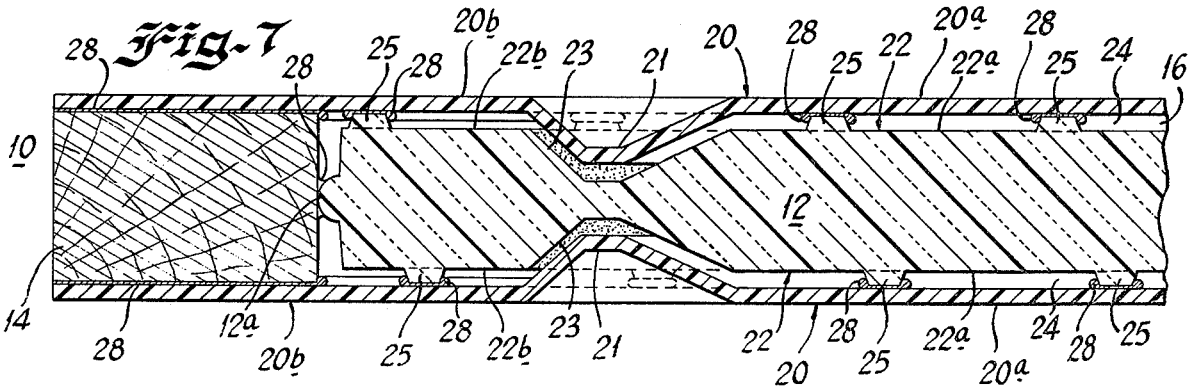

FOAMED PLASTIC CORE DOOR

BACKGROUND OF THE INVENTION

1. Field of the Invention

The present invention relates to a new and improved foamed plastic core door, structural panel, or closure member and more particularly, is directed to a novel construction wherein an inner core formed of light weight cellular plastic foam is provided with an outwardly facing surface having a plurality of relatively small, outwardly projecting, integral bosses arranged in spaced apart intervals thereon for contact against the inside surface of an outer door skin or decorative face member adhesively secured to the bosses.

2. Description of the Prior Art

A wide variety of doors, closure members and architectural structural panels have been provided having a wide variety of decorative outer faces and many different types of inner cores, some being formed of cellular, foamed plastic material. U.S. Pat. No. 3,250,041 discloses a door structure having a core panel of plastic foam and sheets of solid plastic on the outer faces. U.S. Pat. No. 3,479,784 discloses a construction panel having a sheet metal outer skin and an inner core of foam cellular plastic material. U.S. Pat. No. 3,512,305 discloses a metal clad door having a peripheral frame and a core of cellular foam material. U.S. Pat. No. 3,599,703 discloses a storm door having metal outer faces, a foam core and an opening therein for a glazing panel. U.S. Pat. No. 3,629,046 discloses a door having a wooden frame and a core comprising a slab of foam material sandwiched between two sheets of corrugated cardboard between outer face panels formed of aluminum. U.S. Pat. No. 3,987,588 discloses a sheet metal door construction including a metal, rectangular frame around a core of cellular foam sandwiched between a pair of metal door faces.

OBJECTS OF THE PRESENT INVENTION

It is an object of the present invention to provide a new and improved door, structural panel or closure member having an inner core of light weight, cellular foamed plastic material formed with a plurality of small, outwardly projecting, integral bosses arranged in spaced apart intervals for contact with the inside surface of an outer skin or decorative door face adhesively secured thereto.

Another object of the present invention is to provide a new and improved apparatus of the character described wherein the outwardly projecting bosses are compressible in order to accommodate variations in thickness in the outer skin of the door face panel or inner core.

Yet another object of the present invention is to provide a new and improved door of the character described having a peripheral support frame disposed around the outer edges of the inner core including edge frame members sandwiched between inner and outer skins or decorative face panels of the door.

Yet another object of the present invention is to provide a new and improved door member wherein outer face panels on opposite sides are formed of relatively thin sheets of cellulosic or wood fiber materials.

More particularly, it is an object to provide a new and improved door of the character described wherein the outer skins or door face panels are provided with a decorative design which may include planar portions and inwardly indented or embossed recesses or outwardly projecting ridges or ribs.

Yet another object of the present invention is to provide a new and improved Colonial style door having an outer skin or door panel face embossed with the traditional design of a Colonial style paneled door.

Yet another object of the present invention is to provide a new and improved door, structural panel or closure member of the character described wherein an insulating air space or void is provided between outwardly facing surface portions of the cellular foam inner core and the adjacent, confronting inside surface portions of the decorative door face panel or skin.

Yet another object of the present invention is to provide a new and improved door of the character described wherein a molded core of cellular plastic foam material is fitted within a generally rectangular, peripheral framework under slight compression with a pair of decorative outer door face panels adhesively secured to opposite faces of the frame and the outer surfaces of a plurality of relatively small, outwardly, projecting, integral bosses formed in patterns on opposite faces of the inner core.

Yet another object of the present invention is to provide a new and improved door, panel or closure member which is light in weight, rugged and durable in construction, weathertight and which has excellent heat insulating characteristics and is extremely pleasing in appearance.

BRIEF SUMMARY OF THE INVENTION

The foregoing and other objects and advantages of the present invention are accomplished in an illustrative embodiment which comprises a Colonial stype paneled door having an inner core of strong, light weight, foamed cellular, plastic material sandwiched between a pair of opposite door panel faces or skins which are formed of thin sheet material, preferably with a decorative pattern embossed therein. The inner core is formed with a plurality of relatively small, outwardly projecting, compressible bosses at spaced apart positions, preferably in a matrix pattern and the outer surfaces of these bosses are adhesively secured to the inside surfaces of the respective decorative door panel faces so that a thin void, or insulating air space is provided over a relatively large portion of the confronting area between the inner core and sheet members which form the decorative surfaces of the door. Some of the small projecting bosses of the core are slightly compressed when they are adhesively bonded to the inside surface of the door panel faces or outer skin and differences in the amount of compression readily accommodate any variations in the thickness of the skins or inner core to provide a door of substantially uniform thickness, good heat insulating and weathering characteristics as well as great strength and durability.

BRIEF DESCRIPTION OF THE DRAWINGS

For a better understanding of the invention, reference should be had to the following detailed description taken in conjunction with the drawings, in which:

FIG. 4 is a fragmentary, exploded perspective view illustrating fragmentary portions of the major components of the door in accordance with the present invention;

FIG. 5 is a greatly enlarged fragmentary, perspective view of a surface portion of one side face of the inner core of the door;

FIG. 6 is an enlarged, fragmentary, transverse, cross-sectional view of the door but shown with the opposite outer skins or door panel faces spaced apart from the door frame and inner core before the fabrication is completed; and FIG. 7 is an enlarged, fragmentary transverse, cross-sectional view similar to FIG. 6, but illustrating the door after completion with the pair of opposite outer door panel face members adhesively attached against the outwardly projecting bosses on the opposite surfaces of the inner core and door frame in accordance with the present invention.

DESCRIPTION OF THE PREFERRED EMBODIMENT

Figure 1:
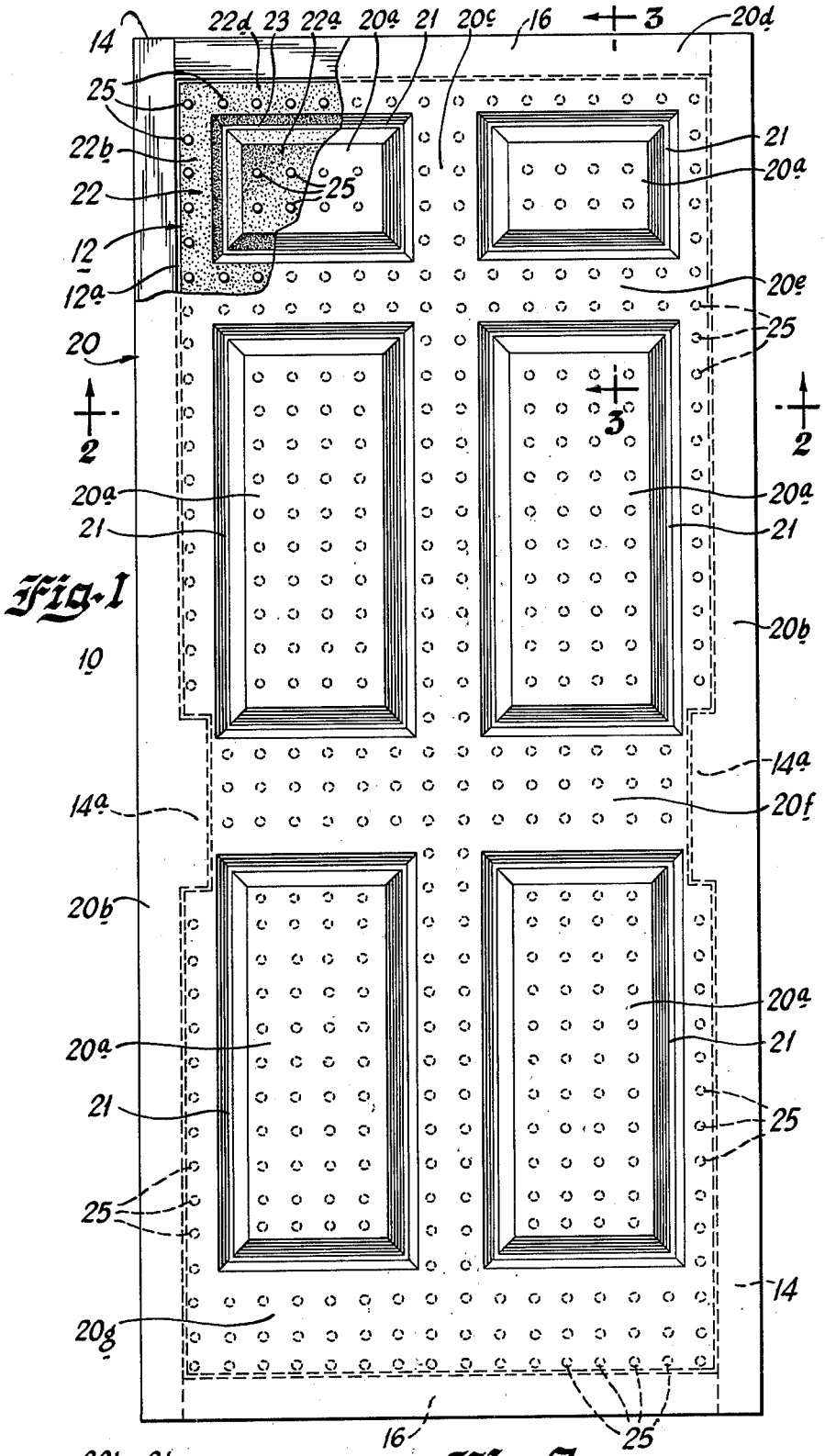
FIG. 1 is an elevational view of a new and improved door constructed in accordance with the features of the present invention and illustrated with a corner portion cut away to show details of the internal construction.
Figure 3:
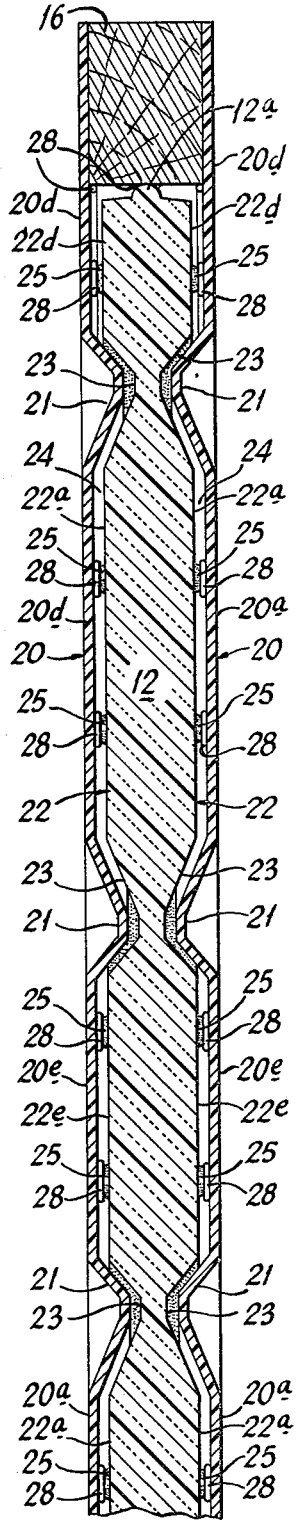
FIG. 3 is a transverse, fragmentary, vertical, cross-sectional view taken substantially along lines 3—3 of FIG. 1.
Figure 2:
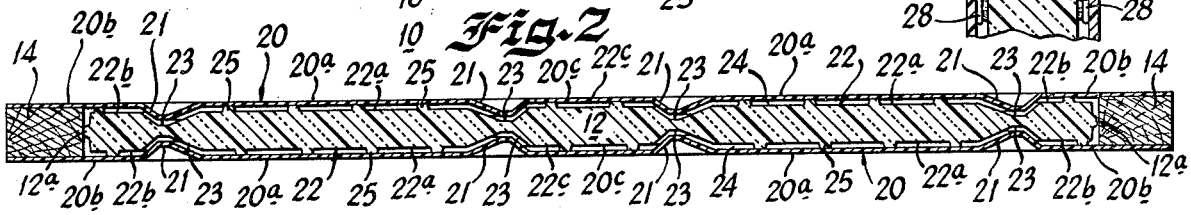
FIG. 2 is a transverse, horizontal, cross-sectional view of the door taken substantially along lines 2—2 of FIG. 1.

Referring now more particularly to the drawings, therein is illustrated a new and improved door, structural panel and/or closure element constructed in accordance with the features of the present invention and referred to generally by the reference numeral 10. The door 10 includes a central core 12 formed of light weight, strong, cellular foamed plastic material and disposed within a rectangular opening formed by a supporting peripheral frame comprising a pair of vertical stiles 14 of wood or other suitable structural material joined together adjacent their upper and lower ends by a pair of upper and lower rails 16 also formed of wood or other suitable structural material.

As illustrated in FIG. 1, the stiles 14 may be provided with an enlarged width portion 14*a* at an intermediate level along the inside edge for supporting and providing a mounting base for a door knob, a latch, a lock or other hardware and the like which may be mounted on the door 10. The door also includes a pair of outer skins or decorative panel faces 20 formed of relatively thin sheet material such as hardboard or the like made of compressed together cellulose/wood fibers. The outer skins or decorative door panel faces 20 are preferably formed with a decorative pattern therein such as the embossed design of a "Colonial" style 6 or 8 panel door.

As illustrated in FIG. 1, a six panel door decorative pattern includes six rectangular shaped, inner panel segments 20*a* arranged in a pair of vertically aligned columns with three sections in each column disposed between a pair of outer vertical stile segments 20*b* and separated by a middle stile segment 20*c*. In the traditional design, a pair of relatively smaller upper panel segments 20*a* are bounded along the upper edge by a horizontal, upper rail segment 20*d* and along the lower edge by an upper intermediate horizontal rail segment 20*e*. Similarly, the middle or intermediate panel segments 20*a* are bounded along a lower edge by a second or lower intermediate rail segment 20*f* and the lower panel segments 20*a* are bounded along the lower edge by a lower rail panel 20*g*.

The resultant embossed design of a six panel "Colonial" style door is exceptionally pleasing in appearance and around the periphery of each of the door panel segments 20*a*, there is formed a rectangular, integrally molded, indentation or embossed recess or trough 21 which adds a relief effect and enhances and improves the appearance of the door 10. The panel faces 20 are treated with a wood grain surface if desired, so that the door 10 closely resembles a real wooden "Colonial" style panel door. The outer door panel faces or skins 20 are embossed under heat pressure to provide the decorative pattern in relief as illustrated and the outer surface of the panel faces may be decorated with wood grain films or a wide variety of processes and finishes to provide an exceptionally nice appearance.

In accordance with the present invention, the inner core 12 of foamed plastic material is molded with a pair of opposite, outwardly facing, side surfaces or faces (as a whole represented by the reference numerals 22) and each side has a molded design formed therein closely resembling and matching but spaced apart inwardly of the closely adjacent inside surfaces of the door panel faces or decorative outer skins 20.

As illustrated in FIGS. 2, 3, 6 and 7, the inner foam core 12 is molded with a thickness dimension such that the respective outer surfaces 22 are spaced inwardly but closely adjacent to the confronting door panel skins to form relatively thin, dead air spaces or voids 24 on opposite sides of the door which encompass substantially all of the surface or total area of the door faces. These thin air spaces or voids greatly improve the heat insulating characteristics of the door and also help to accommodate any variations in thickness of the decorative outer door panel faces 20 as well as thickness variations of the molded, inner core 12. Accordingly, a finished door of substantially uniform thickness dimension is achieved when the panel faces 20 are secured to the core. The opposite sides 22 of the inner core are segmented to match the segments on the panel faces 20 and matching suffix letters have been used to designate segments of the sides 22 of the inner core. For example, adjacent the panel segments 20*a* are closely confronting substantially planar surface portions or segments 22*a* on the inner core 12 and corresponding rail and stile segments on the core faces 22 similarly match those of the outer panel skins.

In accordance with the present invention, planar surfaces 22*a*, 22*b*, 22*c*, 22*d*, 22*e*, 22*f* and 22*g* on opposite side faces 22 of the inner core 12 are integrally molded with a plurality of outwardly projecting bosses 25 of frusto-conical shape arranged in a grid-like matrix pattern of columns and rows as shown in FIG. 1. These bosses or "Crush Cones" are provided over almost the entire area of the opposite side faces 22 except for the areas of contact with the rails 14, the stiles 16 and the rectangular recesses 21 around each panel segment 20*a*. The spacing and interval between adjacent bosses 25 is selected to provide the desired degree of structural integrity and interconnection between the inner core 12 and the adjacent outer door panel face 20.

As illustrated best in FIGS. 5, 6 and 7, the individual projecting bosses or "Crush Cones" are of a frusto-conical shape with a larger diameter base portion adjacent the planar surface segment of the side surface 22 of the inner core and the outer end portion of the bosses is of a smaller diameter. It should also be noted that the "Crush Cones" 25 are shorter in outwardly projecting distance or height than the base diameter thereof.

Before assembly of the panel faces 20 onto the core 12, the height of the bosses is dimensioned as shown in FIG. 6 so that the outer, circular end faces of the respective bosses lie on a plane spaced outwardly of a plane designated as 26 which is aligned with opposite side surfaces of the door frame comprising the stiles 14 and rails 16. This arrangement provides for a slight amount of compression or crushing of the foam in the outer end portion of the "Crush Cones" 25 when the inside surfaces of the outer door faces 20 are brought into adhesive, compressive, contact therewith.

As illustrated in FIGS. 6 and 7, during assembly or manufacturing of the door 10, the opposite faces of the door frame including the stiles 14, and the rails 16 are coated with a layer of adhesive 28 such as waterproof resin before the outer door panel faces 20 are pressed into contact therewith. This layer of adhesive is also applied by a roller or other surface applicator to the outer end surfaces of the bosses or "Crush Cones" 25. When the outer door skins 20 are then moved inwardly into compressive contact to slightly crush the outer end portion of the cones or bosses as shown, the adhesive material 28 on the cones is transformed into small, doughnut-like rings of adhesive around the outer end portion of the conical bosses 25 and this provides an exceptionally good holding for an excellent adhesive bond between the outer end surfaces of the bosses and the inside surfaces of the decorative panel faces 20. It should also be noted that bosses 25 are not provided in the area of the recessed grooves 23 and 21 around the segments 22*a* of the inner core and the segments 20*a* of the decorative panel faces respectively. The transverse cross-sectional shape of the grooved portions provides stiffness for the panel faces 20 around the panel segments 20*a*. The "Crush Cones" 25 are secured to the panel faces at frequent intervals to prevent oil canning or other substantial relative movement between the inner core 12 and the outer face panels. In the relatively flat, larger planar areas of confrontation between the panels and the inner core, the matrix pattern of the cones or bosses 25 provides a strong, structural interconnection and normally prevents rippling or dimples from occurring in the face panels 20 when physical stresses or extreme temperatures are encountered.

The relatively large dead air space areas 24 on opposite sides of the door between the core faces 22 and inside surfaces of the outer skins 20 provides for excellent heat insulating characteristics and the "Crush Cones" 25 permit dimensional variations to be accommodated readily by the compression of the outer end portion of the "Crush Cones."

The resultant door 10 is an extremely strong, but flexible sandwich type cored structure which is light in weight, exceptionally neat and pleasing in appearance and which has exceptional heat insulating characteristics. Moreover, the manufacturing tolerances required for the panel faces 20 are not as close as in other types of cored doors and the use of compressible materials such as corrugated paper or box board sheets to accommodate these types of variations is not needed. Corrugated paper or other compressible type materials often have a tendency to absorb or collect moisture and this proves troublesome and sometimes results in swelling or bulging and eventual failure of the door. In addition, this type of material provides a "mushy" feeling.

The inner core 12 is provided with a continuing rib or ridge 12*a* of generally semi-circular transverse, cross-section around the entire peripheral edge to provide a wedging type fit for the inner core 12 into the large rectangular opening of the door frame. The stiles 14 and rails 16 of the frame are relatively rigid and when the inner core 12 is inserted into the frame, the rounded outer surface of the continuous rib around the entire periphery of the inner core may be compressed slightly to perform a tight wedging fit. Adhesive material 28 may be applied to interconnect the peripheral rib 12*a* and the inside edge of the frame opening.

Because the relatively large, planar surface areas of the inner core 12 are not required to be adhesively secured to the entire area of the inside surfaces of the outer door panel faces 20, a considerable savings in the amount of expensive resin or other type of waterproof adhesive is achieved and with little if any, sacrifice in strength. It has been found that the integral boss-like projections or "Crush Cones" 25 provide for great flexibility during the application of high stress and that extreme temperature variations are accommodated well. The adhesive bond between the frame members 14 and 16, the core 12 and the outer panel faces 20 provides an exceptional sturdy and durable door 10 having an exceptionally nice appearance.

Although the present invention has been described with reference to a single illustrated embodiment thereof, it should be understood that numerous other modifications and embodiments can be devised by those skilled in the art that will fall within the spirit and scope of the principles of this invention.

What is claimed as new and desired to be secured by Letters Patent of the United States is:

1. A closure member comprising:

an inner core of light weight, resinous plastic, relatively rigid type, cellular foam material having an outwardly facing surface formed with a planar base portion having a plurality of small, outwardly projecting compressible bosses arranged in spaced apart intervals in a matrix pattern thereon;

said projecting bosses being formed to be substantially frusto-conical in shape and including a substantially planar outer face of circular shape;

an outer skin for said closure member having an inside surface confronting said core surface in facing spaced apart relation with said planar base portion and in direct contact against outer faces of said projecting bosses;

said skin formed of thin sheet material comprising compressed wood fibres and having smooth planar outer surface portions and an inner surface compressing some of said bosses;

said core including a plurality of said planar base portions at spaced apart locations on said outwardly facing core surface and an intermediate surface portion separating said planar portions without any projecting bosses formed thereon;

said intermediate surface portion being non-planar and said outer skin including a generally matching non-planar inside surface portion in spaced apart relation therewith; and adhesive means for securing said outer skin to said projecting bosses.

2. The closure member of claim 1 wherein said matrix pattern of bosses is formed of parallel rows and parallel columns normal to said row with one of said bosses at the intersection of each row and column.

3. The closure member of claim 1 wherein said outer face of said bosses is smaller in diameter than a base of said bosses adjacent said surface of said core.

4. The closure member of claim 1 wherein said core includes a pair of said outwardly facing surfaces on opposite sides and a pair of said outer skins adhesively secured adjacent respective ones of said surfaces with said adhesive means securing said skins to said bosses.

5. The closure member of claim 4 wherein said skins including marginal edge portions extending beyond an edge of said core and an edge filler element sandwiched between and adhesively securing with inside surfaces along said marginal edge portions of said skins.

6. The closure member of claim 5 wherein said edge of said core includes an elongated rib adhesively secured to an inside edge of said filler element.

7. The closure member of claim 6 wherein said rib includes a rounded outer surface for compression contact against said inside edge of said filler element.

8. The closure member of claim 4, 5, 6 or 7 wherein filler element is formed of wood.

9. The closure member of claim 1 or 4 wherein at least one of said bosses is compressed adjacent its outer face by pressure of said outer skin adhesively secured thereto.

10. A door comprising:

an inner core of light weight, resinous plastic, relatively rigid type, cellular foam material having opposite faces and a peripheral edge, a plurality of outwardly projecting, relatively compressible bosses integrally formed on said faces at spaced apart positions in a matrix pattern thereon;

a pair of opposite door faces formed of thin sheet material compressed wood fibres having a smooth outer surface and an inner surface adhesively secured to compressed faces of said bosses on opposite side faces of said core, a major portion of the total area of said inner surfaces maintained in spaced apart relation from adjacent side faces of said core by the thickness of said compressible bosses, a peripheral frame of structural members extended around the periphery of said core and adhesively sandwiched between facing marginal edge portions of said door face, and said core including an elongated rib formed around the periphery thereof for contact with said members of said frame.

11. The door of claim 10 wherein said bosses are of frusto-conical shape and are arranged in a grid pattern on substantially planar surface portions of said opposite faces of said core.

12. The door of claim 10 wherein said rib has a convexly curved surface for compression against said members of said frame.

13. The door of claim 10 wherein said door faces are formed with an embossed outer surface pattern and an inner surface maintained in spaced apart relation from adjacent face portions of said core except at adjacent said bosses.

14. The door of claim 13 wherein said embossed outer surface on said door faces includes non-planar portions and said core includes confronting non-planar portions adjacent thereto in spaced apart relation.

15. The door of claim 14 wherein said confronting non-planar portions are free of said bosses.

16. The door of claim 11 wherein outer portions of said frusto-conical bosses are compressed inwardly by said door faces.

17. The door of claim 11 wherein said bosses have a diameter greater than the amount of outward projection from an adjacent portion of said core face.

18. The door of claim 17 wherein said bosses have a diameter at the outer face adjacent said door face less than the diameter of a base portion at said adjacent portion of said core face.

* * * * *